US007066351B2

(12) United States Patent
Chang

(10) Patent No.: US 7,066,351 B2
(45) Date of Patent: Jun. 27, 2006

(54) SANITIZED DISPENSING MECHANISM

(76) Inventor: Kil Jae Chang, T. PICO, Korea Manufacturing, 321-37 Suksu, 2 Dong, Anyang City, Kyungdido (KR)

( * ) Notice: Subject to any disclaimer, the term of this patent is extended or adjusted under 35 U.S.C. 154(b) by 142 days.

(21) Appl. No.: 10/804,808

(22) Filed: Mar. 19, 2004

(65) Prior Publication Data

US 2005/0205592 A1 Sep. 22, 2005

(51) Int. Cl.
*B65H 5/00* (2006.01)

(52) U.S. Cl. ..... 221/234; 221/233; 221/255

(58) Field of Classification Search ..... 221/233, 221/234, 256, 257, 265, 277, 289, 291, 24, 221/151, 155, 157, 194, 191, 263, 251, 247
See application file for complete search history.

(56) References Cited

U.S. PATENT DOCUMENTS

| | | | | |
|---|---|---|---|---|
| 1,347,558 | A | 7/1920 | Simon | |
| 1,452,721 | A | 4/1923 | Antoine | |
| 1,490,365 | A | 4/1924 | Grenier | |
| 1,562,152 | A | 11/1925 | Grenier | |
| 1,627,547 | A | 5/1927 | Antoine et al. | |
| 1,640,851 | A | 8/1927 | Oxarart | |
| 1,801,100 | A * | 4/1931 | Meyer | 222/108 |
| 2,193,211 | A | 3/1940 | Taylor | 312/36 |
| 2,653,069 | A | 9/1953 | Mason | 312/89 |
| 2,759,632 | A | 8/1956 | Ussery et al. | 221/199 |
| 2,772,811 | A | 12/1956 | Schaef | 221/155 |
| 3,128,011 | A | 4/1964 | Bleiman | 221/68 |
| 3,198,402 | A | 8/1965 | Hunt et al. | 222/251 |
| 3,335,908 | A | 8/1967 | Johnson | 221/103 |
| 3,894,657 | A | 7/1975 | Eckmayr | 221/265 |
| 4,667,847 | A | 5/1987 | Tucom | 221/68 |
| 5,277,331 | A | 1/1994 | Barbaccia | 221/15 |
| 5,397,025 | A | 3/1995 | Lee | 221/299 |
| 5,421,491 | A * | 6/1995 | Tuvim et al. | 222/336 |
| 5,452,822 | A | 9/1995 | Haymond | 221/155 |
| 5,673,812 | A | 10/1997 | Nelson | 221/82 |
| 5,782,378 | A | 7/1998 | Hart et al. | 221/24 |
| 5,833,117 | A | 11/1998 | Kovens et al. | 221/24 |
| 5,897,022 | A | 4/1999 | Mann | 221/24 |
| 5,979,717 | A * | 11/1999 | Dalton et al. | 222/532 |
| 6,056,151 | A | 5/2000 | Peery et al. | 221/24 |

FOREIGN PATENT DOCUMENTS

| | | |
|---|---|---|
| GB | 2187167 A | 9/1987 |

* cited by examiner

*Primary Examiner*—Gene O Crawford
*Assistant Examiner*—Timothy Waggoner
(74) *Attorney, Agent, or Firm*—John R. Flanagan

(57) ABSTRACT

A sanitized dispensing mechanism mounted to a vending machine includes a receptacle, a barrier and an actuating device. The receptacle has an interior chamber and a rear opening behind the interior chamber through which an item discharged from an exterior opening of the vending machine is received into the interior chamber. The barrier is mounted across the receptacle above a bottom opening below the interior chamber and, in response to a user moving the actuating device between first and second positions, is moved between receiving and dispensing positions. In the receiving position, the barrier receives and retains the item in the interior chamber blocking it from dropping through the bottom opening. In the dispensing position, the barrier releases the item from the interior chamber allowing it to drop through the bottom opening onto a user's hand.

18 Claims, 4 Drawing Sheets

SANITIZED DISPENSING MECHANISM

TECHNICAL FIELD

The present invention generally relates to coin-operated vending machines and, more particularly, is concerned with a sanitized dispensing mechanism for a vending machine.

BACKGROUND ART

Most prior art vending machines dispense their items, such as candy or gum, into a cup on the machine which can be contacted and thus potentially contaminated by a user's hand. Some prior art machines employing such cups are disclosed in U.S. Pat. Nos. 5,452,822, 5,782,378, 5,833,117 and 5,897,022. The inventor herein has discerned that likely there are many potential users who would prefer an alternative way for items to be dispensed from vending machines, such as having the item dropped directly into a user's hand and not into a cup, so that the dispensed item cannot be contaminated through contact with parts of the vending machines which also can be contaminated by users.

Consequently, a need exists for an innovation which will provide a solution to the aforementioned problem of prior art vending machines without introducing any new problems in place thereof.

DISCLOSURE OF INVENTION

The present invention provides a sanitized dispensing mechanism designed to satisfy the aforementioned need. The sanitized dispensing mechanism of the present invention receives an item from an interior discharge chute of a vending machine which is not accessible to a contaminated contact from the exterior of the machine and in response to actuation by a user drops the item into the user's hand such that the item does not contact, and thus cannot become contaminated by, parts of the vending machine vulnerable to contaminated contact by other users.

Accordingly, the present invention is directed to a sanitized dispensing mechanism for a vending machine, comprising: (a) a receptacle attached to a vending machine adjacent to an exterior opening thereof and defining an interior chamber and a rear opening behind the interior chamber contiguous with the exterior opening of the vending machine through which rear opening an item discharged from the exterior opening of the vending machine is received into the interior chamber, the receptacle also defining a bottom opening below the interior chamber; (b) a barrier mounted across the receptacle between the interior chamber and bottom opening thereof and adjacent to the rear opening thereof and the exterior opening of the vending machine and adapted to undergo movement between receiving and dispensing positions such that at the receiving position the barrier receives the item from the vending machine through the exterior opening thereof and the rear opening of the receptacle and retains the item in the interior chamber blocking the item from dropping through the bottom opening of the receptacle whereas at the dispensing position the barrier releases the item from the interior chamber allowing the item to drop through the bottom opening of the receptacle onto a hand of a user of the vending machine; and (c) an actuating device mounted adjacent to the receptacle and coupled to the barrier, the actuating device including an operating lever extending to exteriorly of the receptacle and the vending machine and adapted to be gripped and moved by the user between first and second positions to cause the barrier to move between the receiving and dispensing positions and the item to drop from the interior chamber of the receptacle onto the hand of the user. Multiple embodiments of the sanitized dispensing mechanism are disclosed.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figure 1:
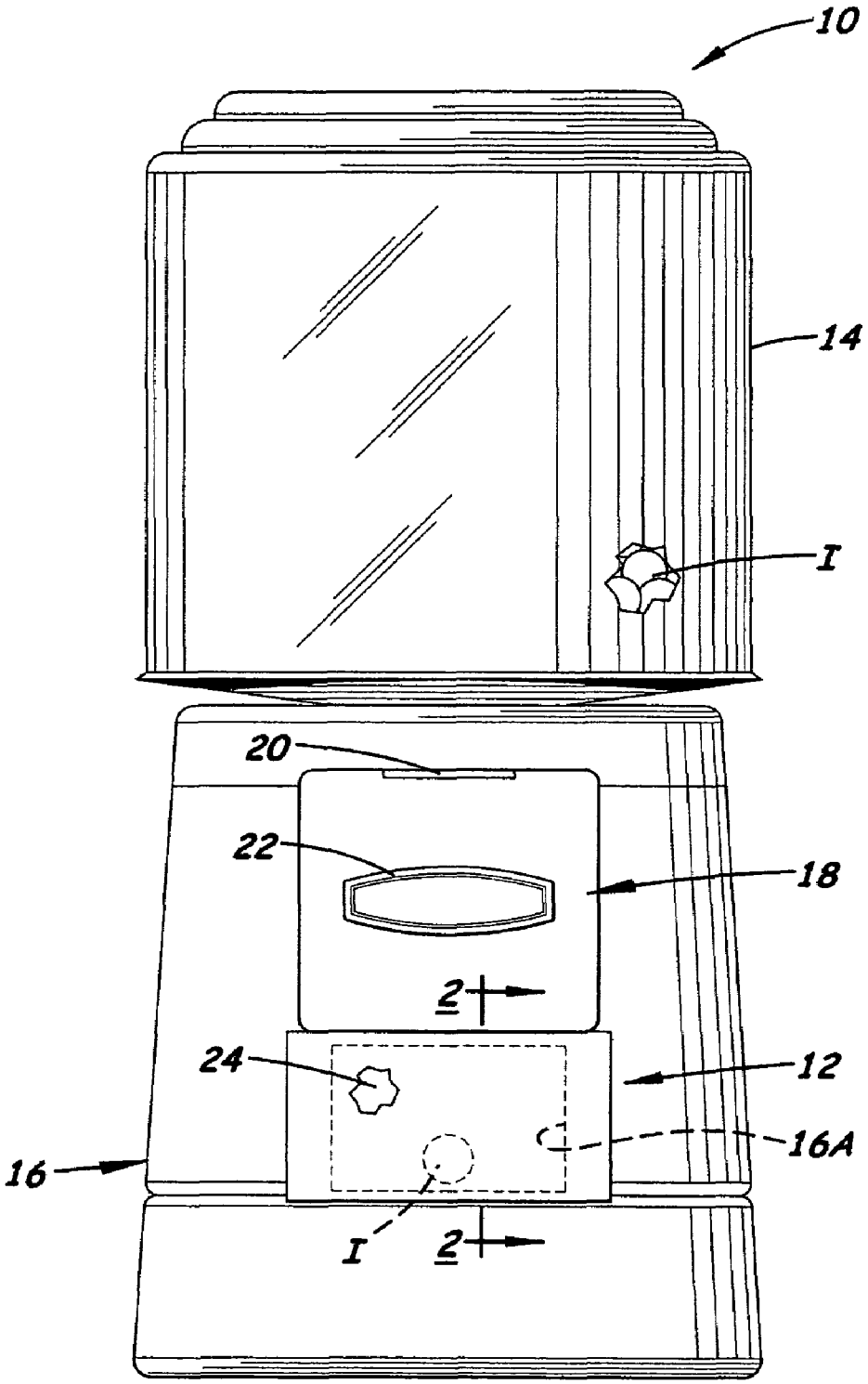
FIG. 1 is a front elevational view of a vending machine incorporating a sanitized dispensing mechanism of the present invention.

Referring to the drawings, and particularly to FIG. 1, there is illustrated a conventional coin-operated vending machine 10 incorporating a sanitized dispensing mechanism of the present invention, generally designated 12. As is well-known, the conventional vending machine 10 has a large transparent globe 14 within which items I, such as candy or gum, are stored and displayed, a pedestal-like base 16 supporting the globe 14, and an actuation mechanism 18 mounted in the base 16 below the globe 14. The actuation mechanism 18 has an external coin slot 20 and a handle or knob 22 adapted to be turned by a user, after depositing a coin in the slot 20, to cause the remainder of the actuation mechanism (not shown) inside of the base 16 to discharge a predetermined quantity of the items I from the globe 14 down a discharge chute 24 in the base 16 to an end 24A of the discharge chute 24 taking the form of a cup (not shown) disposed at an exterior opening 16A in the base 16 which would normally be externally accessible by lifting a pivotal door (not shown) mounted on the exterior of the base 16 so as to overlie the cup. Concurrently, the deposited coin falls into a collection box (not shown) located in the base 16 behind the discharge chute 24. The cup and door of the vending machine 10 have portions that come in contact with the items being dispensed and also are exposed to contaminating contact by hands of users which can result potentially in contaminating items that are later dispensed via the cup and door to later users. The sanitized dispensing mechanism 12 of the present invention avoids this source of potential contamination by replacing the cup and door of the conventional vending machine 10.

Figure 2:
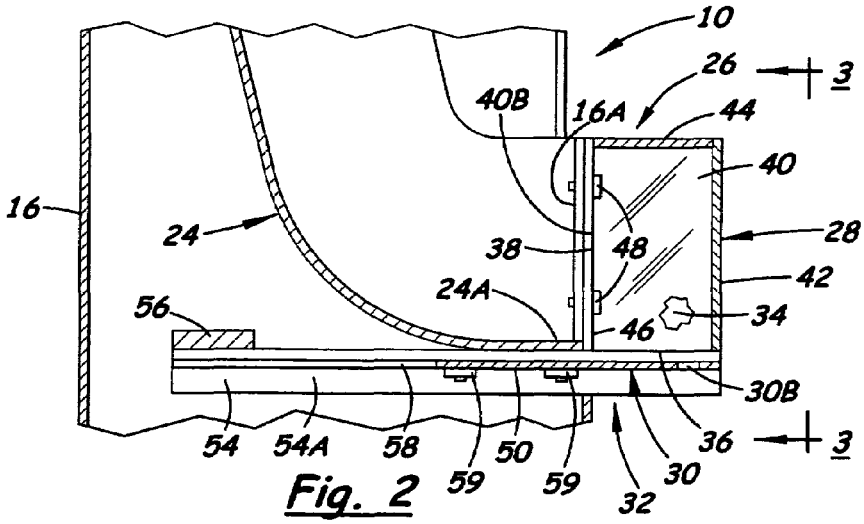
FIG. 2 is an enlarged fragmentary sectional view of the vending machine taken along line 2—2 of FIG. 1 showing a first embodiment of the sanitized dispensing mechanism of the present invention.
Figure 3:
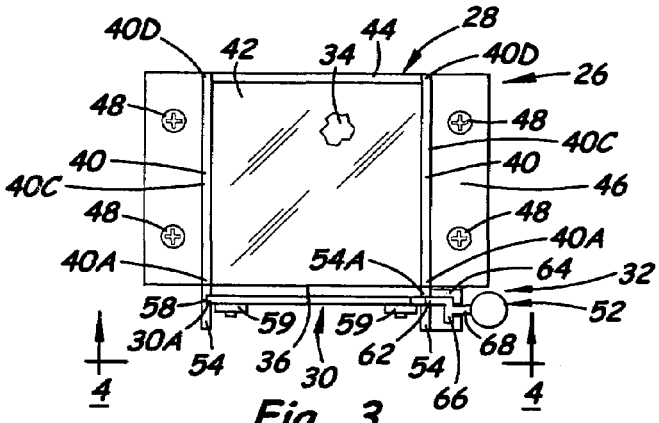
FIG. 3 is a front elevational view of the first embodiment of the sanitized dispensing mechanism as seen along line 3—3 of FIG. 2.
Figure 4:
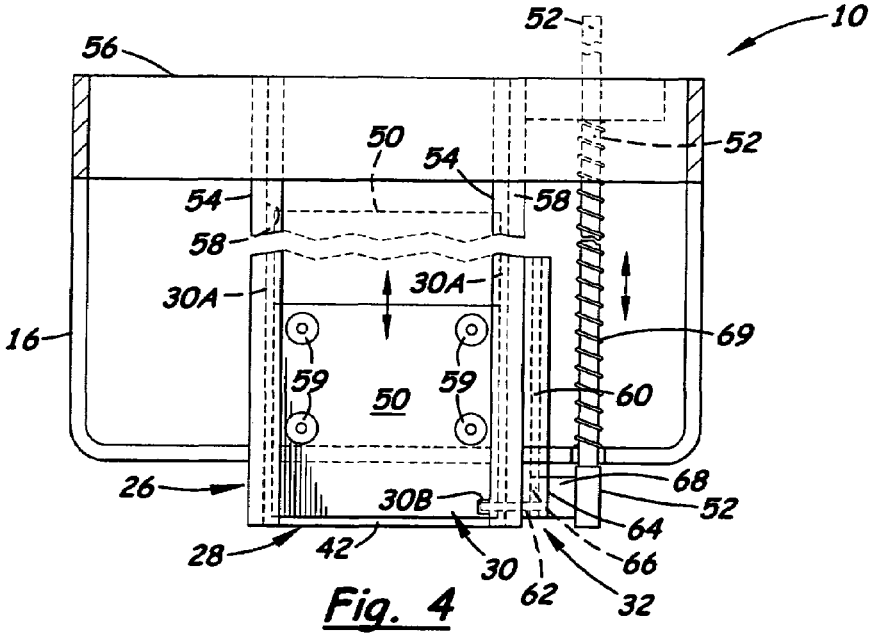
FIG. 4 is a bottom plan view of the first embodiment of the sanitized dispensing mechanism as seen along line 4—4 of FIG. 3.

Referring now to FIGS. 2–4, there is illustrated a first embodiment 26 of the sanitized dispensing mechanism 12. The first embodiment 26 of the sanitized dispensing mechanism basically includes a receptacle 28, a barrier 30 and an actuating device 32. The receptacle 28 is attached to and extends forwardly from the base 16 of the vending machine 10 adjacent to the exterior opening 16A in the base 16. The receptacle 28 defines an interior chamber 34, a bottom opening 36 below the interior chamber 34, and a rear opening 38 behind the interior chamber 34. The rear opening 38 of the receptacle 28 is disposed contiguous with the exterior opening 16A of the base 16. The interior chamber 34 of the receptacle 28, so disposed, can receive through its rear opening 38 an item I discharged via the discharge chute 24 of the base 16 through its exterior opening 16A.

More particularly, the receptacle 28 includes a pair of side walls 40, a front wall 42 and a top wall 44, all being planar in shape and made of a transparent material, such as a suitable rigid plastic. The side walls 40 are laterally spaced apart from one another and at their lower edges 40A define therebetween the bottom opening 36 of the receptacle 28. Also, the side walls 40 at their rear edges 40B define therebetween the rear opening 38 of the receptacle 28. The front wall 42 extends between and interconnects the side walls 40 at their front edges 40C and is disposed opposite from the rear opening 38 of the receptacle 28. The top wall 44 extends between and interconnects the side walls 40 at their upper edges 40D and is disposed opposite from the bottom opening 36 of the receptacle 28. The side walls 40, front wall 42 and top wall 44 together define the interior chamber 34 of the receptacle 28. Also, the receptacle 28 includes a pair of mounting flanges 46 of planar shape attached to and extending in opposite directions away from one another and away from the rear edges 40B of the side walls 40. The mounting flanges 46 have pairs of holes (not shown) adapted to receive fasteners 48 for attaching the receptacle 28 to the base 16 of the vending machine 10 such that the rear opening 38 of the receptacle 28 is disposed contiguous with the exterior opening 16A of the vending machine 10.

The barrier 30 is mounted across the receptacle 28 between its interior chamber 34 and bottom opening 36 and adjacent to its rear opening 38 and the exterior opening 16A of the base 16 of the vending machine 10. The barrier 30 is mounted to the base 16 so as to adapt it to undergo movement between receiving and dispensing positions, as seen in FIG. 4, At its receiving position, the barrier 30 receives the item I from the vending machine 10 through the exterior opening 16A of the base 16 thereof and the rear opening 38 of the receptacle 28 and retains the item I in the interior chamber 34 blocking the item I from dropping through the bottom opening 36 of the receptacle 28. At its dispensing position, the barrier 30 releases the item I from the interior chamber 34 allowing the item I to drop through the bottom opening 36 of the receptacle 28 onto a hand of a user of the vending machine 10. In the first embodiment 26 of the sanitized dispensing mechanism 12, the barrier 30 specifically takes the form of a door 50 of substantially planar shape constituting a false floor for the receptacle 28 which extends across the bottom opening 36 thereof when the barrier 30 is disposed at its receiving position.

The actuating device 32 is mounted adjacent to the receptacle 28 and coupled to the barrier 30. The actuating device 32 includes an operating lever 52 extending to exteriorly of the receptacle 28 and the vending machine 10 and adapted to be gripped and moved by the user between first and second positions, as seen in solid and dashed line forms in FIG. 4, to cause the barrier 30 to move between the receiving and dispensing positions, also seen in solid and dashed line forms in FIG. 4, and the item to drop from the interior chamber 34 of the receptacle 28 onto the hand of the user. The actuating device 32 also includes a pair of straight tracks 54 laterally spaced apart from one another and mounted via struts 56 to the vending machine 10 below and extending rearwardly of the bottom opening 36 of the receptacle 28 such that the tracks 54 extend into the vending machine 10 below the exterior opening 16A of the base 16. Each of the tracks 54 has an elongated guide element 58, such as being in the form of a recess or groove, formed thereon at an inner side 54A of each track 54 and facing toward the other track 54. The barrier 30 is disposed between the tracks 54 and has a pair of opposite edges 30A slidably supported by the guide elements 58 of the tracks 54 such that the barrier 30 is slidably movable in a rectilinear path along the tracks 54 between the receiving and dispensing positions. Pairs of rollers 59 are rotatably mounted to the underside of the barrier 30 along the respective opposite edges 30A thereof and adapted to make rolling contact with the tracks 54 so as to prevent binding of the barrier 30 with the tracks 54 during the rectilinear movement of the barrier 30. One of the tracks 54 is disposed adjacent to the operating lever 52 and has an elongated slot 60 formed through the one track 54 below and along part of the length of the guide element 58.

The actuating device 32 also has a link element 62 extending through the slot 60 and into a notch 30B formed in the one edge 30A of the barrier 30 so as to thereby couple the operating lever 52 to the barrier 30 such that linear movement of the operating lever 52 will cause the rectilinear movement of the barrier 30. The actuating device 32 further includes an elongated rail 64 attached to the one track 54. The rail 64 defines an elongated guide channel 66 extending parallel to the guide elements 58 of the tracks 54. The guide channel 66 of the rail 64 receives an elongated rib 68 rigidly attached to and extending laterally from the operating lever 52 such that the linear movement of the operating lever 52 between its first and second positions without binding thereof is facilitated by the sliding movement of the rib 68 in the channel 66 of the rail 64 along a path disposed substantially parallel to a path along which the barrier 30 is moved between its receiving and dispensing positions. The actuating device 32 further includes a coiled spring 69 encircling the operating lever 52 so as to bias the operating lever 52 from its second position, as seen in broken line form in FIG. 4, back to its first position, as shown in solid line form in FIG. 4, and thus bias the door 50 to move from the dispensing position, as shown in broken line form in FIG. 4, to the receiving position, as seen in solid line form in FIG. 4.

Figure 5:
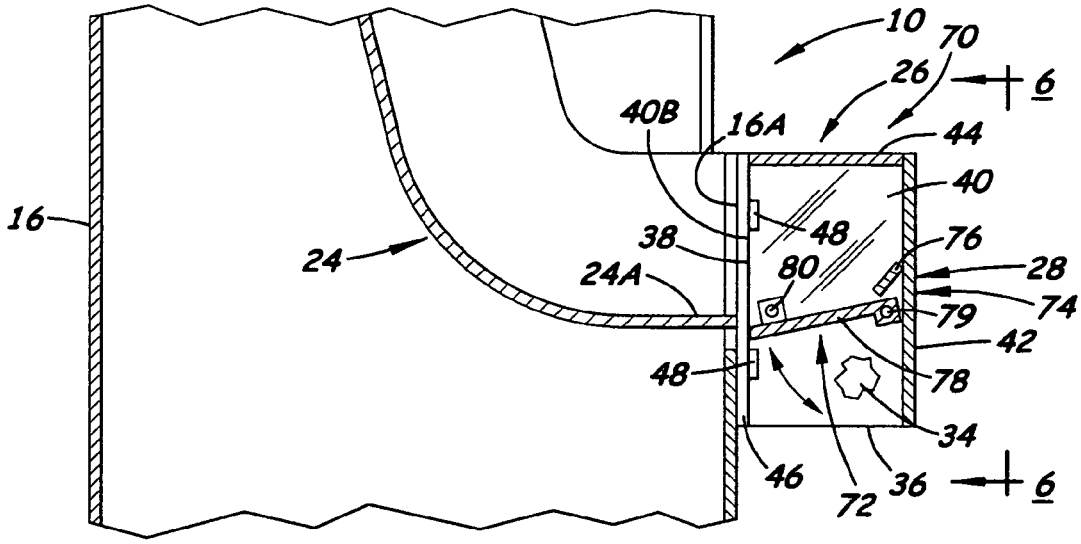
FIG. 5 is another enlarged fragmentary sectional view of the vending machine similar to that of FIG. 2 now showing a second embodiment of the sanitized dispensing mechanism of the present invention.
Figure 6:
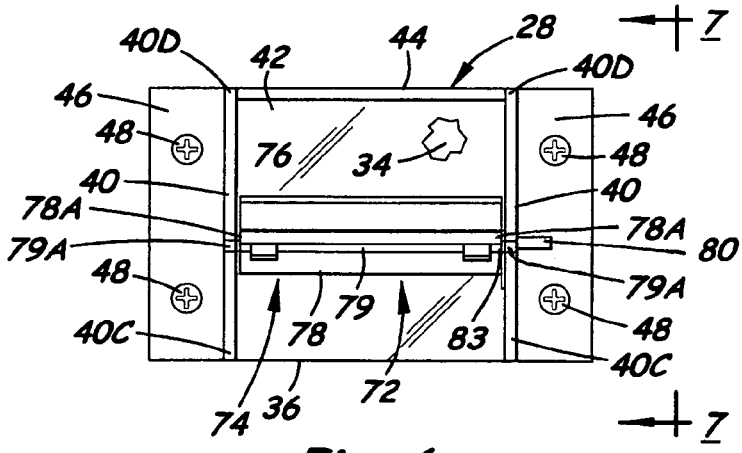
FIG. 6 is a front elevational view of the second embodiment of the sanitized dispensing mechanism as seen along line 6—6 of FIG. 5.
Figure 7:
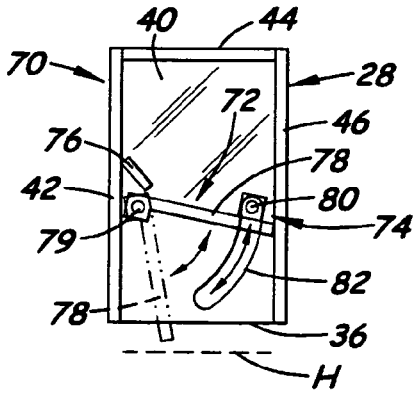
FIG. 7 is a side elevational view of the second embodiment of the sanitized dispensing mechanism as seen along line 7—7 of FIG. 6.

Referring now to FIGS. 5–7, there is illustrated a second embodiment 70 of the sanitized dispensing mechanism 12. The second embodiment 70 of the mechanism 12 includes a receptacle 28 having substantially the same construction as the receptacle 28 in the first embodiment 26. The second embodiment 70 of the mechanism 12 also includes a barrier 72 and an actuating device 74 which, however, are different from their counterparts in the first embodiment 26. The barrier 72 includes a stationary ledge 76 fixedly mounted to the receptacle 28 and extending across a portion of the bottom opening 36 thereof. The stationary ledge 76 is mounted to one of the front wall 42 and the opposite side walls 40. The barrier 72 also includes a movable door 78 pivotally mounted to the receptacle 28 by a shaft 79 disposed below the stationary ledge 76 and mounted at its opposite ends 79A to the side walls 40 of the receptacle 28 such that the movable door 78 extends across a remainder of the bottom opening 36 thereof when the barrier 72 is disposed at its receiving position. The actuating device 74 has an operating lever 80 attached to one of a pair of opposite sides 78A of the movable door 78. The one side wall 40 has an arcuate-shaped slot 82 defined therethrough and disposed adjacent to the one side 78A of the door 78 such that the operating lever 80 extends through the slot 82 in the one side wall 40. The actuating device 74 further includes a coiled spring 83 encircling one of the opposite ends 79A of the shaft 79 and engaged with the one side wall 40 and the movable door 78 so as to bias the movable door 78 to move from the dispensing position, as shown in broken line form in FIG. 7, to the receiving position, as seen in solid line form in FIG. 7.

Figure 8:
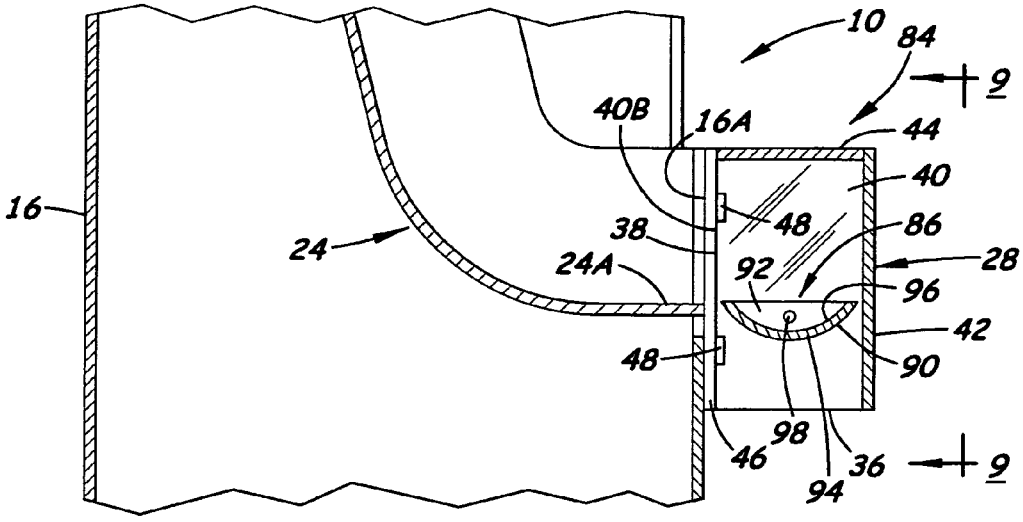
FIG. 8 is a still another enlarged fragmentary sectional view of the vending machine similar to that of FIGS. 2 and 5 now showing a third embodiment of the sanitized dispensing mechanism of the present invention.
Figure 9:
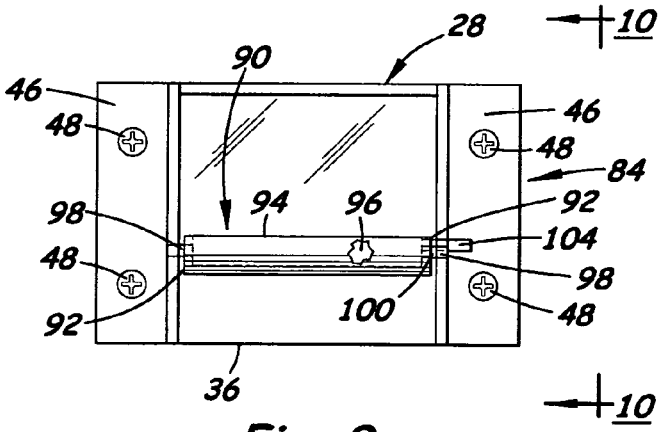
FIG. 9 is a front elevational view of the third embodiment of the sanitized dispensing mechanism as seen along line 9—9 of FIG. 8.
Figure 10:
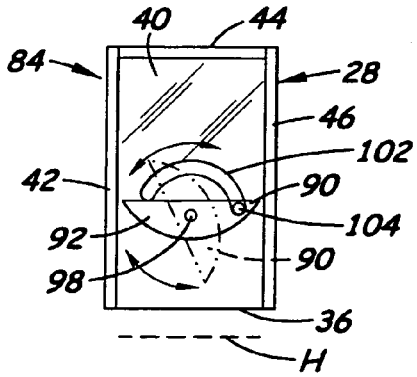
FIG. 10 is a side elevational view of the third embodiment of the sanitized dispensing mechanism as seen along line 10—10 of FIG. 9.

Referring now to FIGS. 8–10, there is illustrated a third embodiment 84 of the sanitized dispensing mechanism 12. The third embodiment 84 of the mechanism 12 includes a receptacle 28 having substantially the same construction as the receptacle 28 in the first and second embodiments 26, 70. The third embodiment 84 of the mechanism 12 also includes a barrier 86 and an actuating device 88 which, however, are different from their counterparts in the first and second embodiments 26, 70. The barrier 86 is a door 90 of semi-cylindrical shape having a pair of opposite end portions 92 disposed in planes substantially parallel to one another and a semi-cylindrical portion 94 which extends between and interconnects the opposite end portions 92 so as to form a cavity 96 into which an item I is received. The barrier 86 also includes a pair of stub shafts 98 supporting the door 90 at its opposite end portions 92 and pivotally mounting the door 90 to the side walls 40 of the receptacle 28. The actuating device 88 further includes a coiled spring 100 encircling one of the stub shafts 98 and engaged with the one side wall 40 and the door 90 so as to bias the door 90 to the receiving position, as shown in solid line form in FIG. 7, in which the cavity 96 opens in an upward direction. The side wall 40 of the receptacle 28 has an arcuate-shaped slot 102 defined therethrough and is disposed adjacent to the one end portion 92 of the door 90 such that an operating lever 104 is attached to the one end portion 92 of the door 90 and extends through the slot 102 in the one side wall 40 where it can be gripped by a user to rotate the door 90 to the dispensing position, as seen in broken line form in FIG. 7.

Thus, as described above, until it is actuated the barrier 30, 72, 86 in each embodiment 26, 70, 84 of the sanitized dispensing mechanism 12 prevents the item I from dropping from the receptacle 28 into the user's hand and also retains the item I so as to prevent it from being reached by the user's hand. The operating lever 52, 80, 104 accessible at the exterior of the vending machine 10 must be actuated by the user in order to cause the barrier 30, 72, 86 to release the item so as to allow it to drop from the receptacle 28 into the user's hand. The result is that the item is dropped from an interior chamber 34 of the receptacle 28 which is not accessible by a contaminated contact from the exterior of the vending machine 10 so that the item dropping into the user's hand cannot become contaminated through contact with exterior machine parts which may have been contaminated by other users.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

The invention claimed is:

1. A sanitized dispensing mechanism for a vending machine, comprising:

(a) a receptacle attached to a vending machine adjacent to an exterior opening thereof and defining an interior chamber and a rear opening behind said interior chamber contiguous with the exterior opening of the vending machine through which rear opening an item discharged from the exterior opening of the vending machine is received into said interior chamber, said receptacle having a bottom opening below said interior chamber;

(b) a barrier mounted across said receptacle between said interior chamber and said bottom opening thereof and adjacent to said rear opening thereof and the exterior opening of the vending machine and adapted to undergo movement between receiving and dispensing positions such that at said receiving position said barrier receives the item from the vending machine through the exterior opening thereof and said rear opening of said receptacle and retains the item in said interior chamber blocking the item from dropping through said bottom opening of said receptacle whereas at said dispensing position said barrier releases the item from said interior chamber allowing the item to drop through said bottom opening of said receptacle onto a hand of a user of the vending machine; and (c) an actuating device mounted adjacent to said receptacle and coupled to said barrier, said actuating device including an operating lever extending to exteriorly of said receptacle and the vending machine and adapted to be gripped and moved by the user between first and second positions to cause said barrier to move between said receiving and dispensing positions and the item to drop from said interior chamber of said receptacle onto the hand of the user;

(d) wherein said receptacle includes (i) a pair of side walls laterally spaced apart from one another, said side walls defining therebetween at lower edges thereof said bottom opening of said receptacle, said side walls defining therebetween at rear edges thereof said rear opening of said receptacle, (ii) a front wall extending between and interconnecting said side walls at front edges thereof and being disposed opposite from said rear opening of said receptacle, and (iii) a top wall extending between and interconnecting said side walls at upper edges thereof and being disposed opposite from said bottom opening of said receptacle, said side walls, front wall and top wall together defining said interior chamber of said receptacle.

2. The mechanism of claim 1 wherein said receptacle further includes a pair of mounting flanges attached to and extending in opposite directions away from one another and away from said rear edges of said side walls, said mounting flanges being adapted to receive fasteners for attaching said receptacle to the vending machine such that said rear opening of said receptacle is disposed contiguous with the exterior opening of the vending machine.

3. The mechanism of claim 1 wherein said side walls, front wall and top wall of said receptacle are made of a transparent material.

4. The mechanism of claim 1 wherein said actuating device further includes a pair of tracks laterally spaced apart from one another and mounted to the vending machine below said bottom opening of said receptacle and extending into the vending machine below the exterior opening thereof, each of said tracks having an elongated guide element formed thereon at an inner side thereof facing toward one another, said barrier disposed between said tracks and having a pair of opposite edges slidably supported by said guide elements of said tracks such that said barrier is movable along said tracks between said receiving and dispensing positions, one of said tracks disposed adjacent to said operating lever and having an elongated slot formed through said one track and receiving through said slot a link element that couples said operating lever to said barrier.

5. The mechanism of claim 4 wherein said barrier is a door of substantially planar configuration constituting a false floor for said receptacle extending across said bottom opening thereof when said barrier is disposed at said receiving position.

6. The mechanism of claim 4 wherein said actuating device further includes an elongated rail attached to said one track and having an elongated guide channel extending parallel to said guide elements of said tracks and receiving an elongated rib rigidly attached to and extending laterally from said operating lever such that said operating lever is moved between said first and second positions thereof along a path disposed parallel to a path along which said barrier is moved between said receiving and dispensing positions thereof.

7. The mechanism of claim 6 wherein said actuating device further includes an elongated coiled spring encircling a portion of said operating lever and engaged therewith so as to bias said operating lever to said first position and said door toward said receiving position.

8. The mechanism of claim 1 wherein said barrier includes:

a stationary ledge fixedly mounted to one of said front wall and said side walls of said receptacle and extending across a portion of said bottom opening thereof; and a movable door pivotally mounted to said receptacle adjacent to said stationary ledge and extending across a remainder of said bottom opening thereof when said barrier is disposed at said receiving position.

9. The mechanism of claim 8 wherein said operating lever of said actuating device is attached to one of a pair of opposite sides of said door, and wherein one of said opposite side walls has an arcuate-shaped slot defined therethrough and disposed adjacent to said one of said opposite sides of said door such that said operating lever extends through said slot in said one of said side walls.

10. The mechanism of claim 9 wherein said receptacle is made of a transparent material.

11. The mechanism of claim 8 wherein said barrier also includes a shaft supporting said door and pivotally mounting said door to said side walls of said receptacle, said actuating device further including a coiled spring encircling said shaft and engaged with said front wall and said door so as to bias said door toward said receiving position.

12. The mechanism of claim 8 wherein said receptacle further includes a pair of mounting flanges attached to and extending in opposite directions away from one another and away from said rear edges of said side walls, said mounting flanges being adapted to receive fasteners for attaching said receptacle to the vending machine such that said rear opening of said receptacle is disposed contiguous with the exterior opening of the vending machine.

13. A sanitized dispensing mechanism for a vending machine, comprising:

(a) receptacle attached to a vending machine adjacent to an exterior opening thereof and defining an interior chamber and a rear opening behind said interior chamber contiguous with the exterior opening of the vending machine through which rear opening an item discharged from the exterior opening of the vending machine is received into said interior chamber, said receptacle having a bottom opening below said interior chamber;

(b) a barrier mounted across said receptacle between said interior chamber and said bottom opening thereof and adjacent to said rear opening thereof and the exterior opening of the vending machine and adapted to undergo movement between receiving and dispensing positions such that at said receiving position said barrier receives the item from the vending machine through the exterior opening thereof and said rear opening of said receptacle and retains the item in said interior chamber blocking the item from dropping through said bottom opening of said receptacle whereas at said dispensing position said barrier releases the item from said interior chamber allowing the item to drop through said bottom opening of said receptacle onto a hand of a user of the vending machine; and (c) an actuating device mounted adjacent to said receptacle and coupled to said barrier, said actuating device including an operating lever extending to exteriorly of said receptacle and the vending machine and adapted to be gripped and moved by the user between first and second positions to cause said barrier to move between said receiving and dispensing positions and the item to drop from said interior chamber of said receptacle onto the hand of the user;

(d) wherein said barrier is a door having a pair of opposite end portions disposed in planes substantially parallel to one another and a semi-cylindrical portion extending between and interconnecting said opposite end portions so as to form a cavity into which an item is received.

14. The mechanism of claim 13 wherein said operating lever of said actuating device is attached to one of said opposite end portions of said door.

15. The mechanism of claim 14 wherein said receptacle is made of a transparent material.

16. The mechanism of claim 14 wherein said receptacle includes a pair of side walls laterally spaced apart from one another, said side walls defining therebetween at lower edges thereof said bottom opening of said receptacle, said side walls defining therebetween at rear edges thereof said rear opening of said receptacle, one of said side walls having an arcuate-shaped slot defined therethrough and disposed adjacent to said one opposite end portion of said door such that said operating lever extends through said slot in said one side wall.

17. The mechanism of claim 16 wherein said barrier also includes a pair of stub shafts supporting said door at said opposite end portions thereof and pivotally mounting said door to said side walls of said receptacle, said actuating device further including a coiled spring encircling one of said stub shafts and engaged with said one side wall and said door so as to bias said door toward said receiving position.

18. The mechanism of claim 16 wherein said receptacle further includes a pair of mounting flanges attached to and extending in opposite directions away from one another and away from said rear edges of said side walls, said mounting flanges being adapted to receive fasteners for attaching said receptacle to the vending machine such that said rear opening of said receptacle is disposed contiguous with the exterior opening of the vending machine.

* * * * *